US009142876B2

(12) United States Patent
Chen et al.

(10) Patent No.: US 9,142,876 B2
(45) Date of Patent: Sep. 22, 2015

(54) PLANAR ANTENNA AND HANDHELD DEVICE

(75) Inventors: Min-Che Chen, Taoyuan County (TW); Chia-I Lin, Taoyuan County (TW); Chih-Wei Hsu, Taoyuan County (TW)

(73) Assignee: HTC Corporation, Taoyuan (TW)

( * ) Notice: Subject to any disclaimer, the term of this patent is extended or adjusted under 35 U.S.C. 154(b) by 838 days.

(21) Appl. No.: 13/041,435

(22) Filed: Mar. 7, 2011

(65) Prior Publication Data

US 2011/0241962 A1 Oct. 6, 2011

(30) Foreign Application Priority Data

Mar. 30, 2010 (TW) ..... 99109633 A

(51) Int. Cl.

| | |
|---|---|
| ***H01Q 1/24*** | (2006.01) |
| ***H01Q 1/52*** | (2006.01) |
| ***H01Q 9/42*** | (2006.01) |
| ***H01Q 21/28*** | (2006.01) |
| ***H01Q 5/10*** | (2015.01) |

(52) U.S. Cl.

CPC ..... *H01Q 1/243* (2013.01); *H01Q 1/521* (2013.01); *H01Q 5/10* (2015.01); *H01Q 9/42* (2013.01); *H01Q 21/28* (2013.01)

(58) Field of Classification Search

CPC ..... H01Q 1/243; H01Q 1/521; H01Q 21/28
See application file for complete search history.

(56) References Cited

U.S. PATENT DOCUMENTS

| | | | | |
|---|---|---|---|---|
| 6,717,551 | B1 * | 4/2004 | Desclos et al. | 343/700 MS |
| 2004/0137950 | A1 | 7/2004 | Bolin et al. | |
| 2008/0258991 | A1 | 10/2008 | Montgomery et al. | |
| 2008/0278405 | A1 | 11/2008 | Montgomery et al. | |
| 2009/0322639 | A1 * | 12/2009 | Lai | 343/770 |

FOREIGN PATENT DOCUMENTS

| | | |
|---|---|---|
| EP | 1881554 | 1/2008 |
| TW | 201001800 | 1/2010 |
| WO | 02078123 | 10/2002 |

OTHER PUBLICATIONS

ARRLAntennaBookOnAntennaScaling_[Antenna Frequency Scaling] from [The ARRL Antenna Book,] published by The American Radio Relay League, Copyright 1988, p. 2-24 to 2-25.*

"Search Report of European Counterpart Application", issued on Jul. 8, 2011, p. 1-p. 16, in which the listed references were cited.

Cyril Luxey, "Design of Multi-Antenna Systems for UMTS Mobile Phones", 2009 Loughborough Antenna&Propagation Conference, Nov. 16-17, 2009, pp. 57-64.

(Continued)

*Primary Examiner* — Robert Karacsony

(74) *Attorney, Agent, or Firm* — Jianq Chyun IP Office

(57) ABSTRACT

A planar antenna and a handheld device are provided. The handheld device includes the planar antenna and a system ground plane. The planar antenna has a first feed point, a first ground point, a second feed point, and a second ground point. The first ground point and the second ground point are located between the first feed point and the second feed point. The system ground plane is electrically connected to the first feed point, the first ground point, the second feed point, and the second ground point. Thereby, the performance in radio signal transceiving is improved.

6 Claims, 8 Drawing Sheets

(56) References Cited

OTHER PUBLICATIONS

Diallo et al., "Study and Reduction of the Mutual Coupling Between Two Mobile Phone PIFAs Operating in the DCS1800 and UMTS Bands", IEEE Transactions on Antennas and Propagation, Nov. 1, 2006, pp. 3063-3074, vol. 54, No. 11.

Diallo et al., "Reduction of the mutual coupling between two planar inverted-F antennas working in close radiocommunication standards", Conference on Applied Electromagnetics and Communications, Oct. 12-14, 2005, pp. 1-4.

Diallo et al., "Efficient two-port antenna system for GSM/DCS/UMTS multimode mobile phones", Electronics Letters, Mar. 29, 2007, pp. 369-370, vol. 43, No. 7.

Fujimoto et al., "Small antennas", Small Antennas, Jan. 1, 1993, pp. 116-121, Small & Antennas, RSP & Wiley.

"First Office Action of China counterpart application" issued on Mar. 15, 2013, p. 1-p. 8, in which the listed references were cited.

"Office Action of Europe Counterpart Application", issued on Mar. 11, 2015, p. 1-p. 10.

* cited by examiner

PLANAR ANTENNA AND HANDHELD DEVICE

CROSS-REFERENCE TO RELATED APPLICATION

This application claims the priority benefit of Taiwan application serial no. 99109633, filed on Mar. 30, 2010. The entirety of the above-mentioned patent application is hereby incorporated by reference herein and made a part of this specification.

BACKGROUND OF THE INVENTION

1. Field of the Invention

The subject application generally relates to a planar antenna, and more particularly, to a planar antenna of a handheld device.

2. Description of Related Art

Multi-input multi-output (MIMO) is a term used for describing the transmission of radio signals between multiple antennas. In short, MIMO refers to the use of multiple antennas respectively at a transmitter and a receiver, wherein signals are transmitted and received by the antennas at the transmitter and the receiver so that the service quality provided to each user is improved. Compared to a conventional signal-antenna system, the MIMO technology offers an increased frequency available ratio such that the system can transmit data more efficiently with limited wireless bandwidth.

FIG. 1 is a diagram of a conventional MIMO handheld device. FIG. 2 is a diagram illustrating the signal quality (VSWR) of a planar antenna in FIG. 1. Referring to FIG. 1 and FIG. 2, a handheld device 100 adopts two planar antennas 110 and 120. The planar antenna 110 has a feed point F110 and a ground point G110. The planar antenna 120 has a feed point F120 and a ground point G120. Because the planar antennas 110 and 120 have similar operating frequencies, signals transmitted and received by the planar antennas 110 and 120 may interfere with each other. The interference cannot be effectively eliminated (as shown in FIG. 2) even when the planar antennas 110 and 120 are respectively disposed at two different sides of the handheld device 100. In FIG. 2, the curve 131 indicates the transceiving quality of the planar antenna 110, the curve 132 indicates the transceiving quality of the planar antenna 120, and the curve 133 indicates the situation of signal interference.

Generally speaking, a planar antenna requires a clearance area. If two planar antennas are respectively disposed at two different sides of a handheld device, a greater total clearance area is required by the two planar antennas and which is disadvantageous to the circuit layout of the handheld device. Besides, there may not be enough space for respectively disposing two planar antennas at two different sides of a handheld device. The closer the two planar antennas are, the more serious the problem of signal interference is. Moreover, the problem of signal interference is aggravated if three or more antennas are disposed in a handheld device.

SUMMARY OF THE INVENTION

Accordingly, the subject application is directed to a planar antenna with improved performance in radio signal transceiving.

The subject application is also directed to a handheld device, wherein two antennas are integrated into one antenna so that noise interference to the antenna is reduced.

The subject application provides a planar antenna including a connecting portion, a first antenna portion, and a second antenna portion. The first antenna portion comprises a first feed point and a first ground point. A first end of the first antenna portion is connected to a first end of the connecting portion. The first feed point is located between the first end and a second end of the first antenna portion. The first ground point is located between the first feed point and the first end of the first antenna portion. The second antenna portion comprises a second feed point and a second ground point. A first end of the second antenna portion is connected to a second end of the connecting portion. The second feed point is located between the first end and a second end of the second antenna portion. The second ground point is located between the second feed point and the first end of the first antenna portion.

According to an embodiment of the subject application, the connecting portion sets with a width, and the impedance of the connecting portion is in a positive correlation to the width thereof. According to another embodiment, the connecting portion sets with a length, and the impedance of the connecting portion is in a negative correlation to the length thereof.

According to an embodiment of the subject application, the first antenna portion includes a radiating portion and an extending portion, wherein the extending portion is extended outwards from the radiating portion, the first feed point and the first ground point are disposed at the extending portion, and a center frequency of the first antenna portion is determined according to the distance between the first feed point and the first ground point.

According to an embodiment of the subject application, the second antenna portion includes a radiating portion, a first extending portion, and a second extending portion, wherein the first extending portion and the second extending portion are respectively extended outwards from the radiating portion, the second feed point and the second ground point are respectively disposed at the first extending portion and the second extending portion, and a center frequency of the second antenna portion is determined according to a signal path length between the second feed point and the second ground point.

According to an embodiment of the subject application, the first antenna portion includes a first radiating portion, and the second antenna portion includes a second radiating portion. The frequency of the first antenna portion is determined according to the length of the first radiating portion, and the frequency of the second antenna portion is determined according to the length of the second radiating portion, wherein the frequency of the first antenna portion and the frequency of the second antenna portion are substantially with fundamental-harmonic relationships.

According to an embodiment of the subject application, the connecting portion, the first antenna portion, and the second antenna portion are made of a flexible conductive material, and the planar antenna is flexibly disposed at a fixing device to present a three-dimensional (3D) structure.

The subject application also provides a handheld device including a planar antenna and a system ground plane. The planar antenna comprises a first feed point, a first ground point, a second feed point, and a second ground point. The first ground point and the second ground point are located between the first feed point and the second feed point. The system ground plane is electrically connected to the first feed point, the first ground point, the second feed point, and the second ground point.

As described above, in the subject application, two antennas are integrated into one planar antenna, and the planar antenna comprises two feed points and two ground points, wherein the ground points are located between the feed points. Thereby, interference between antennas is eliminated and the space disposition of the antenna is improved.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
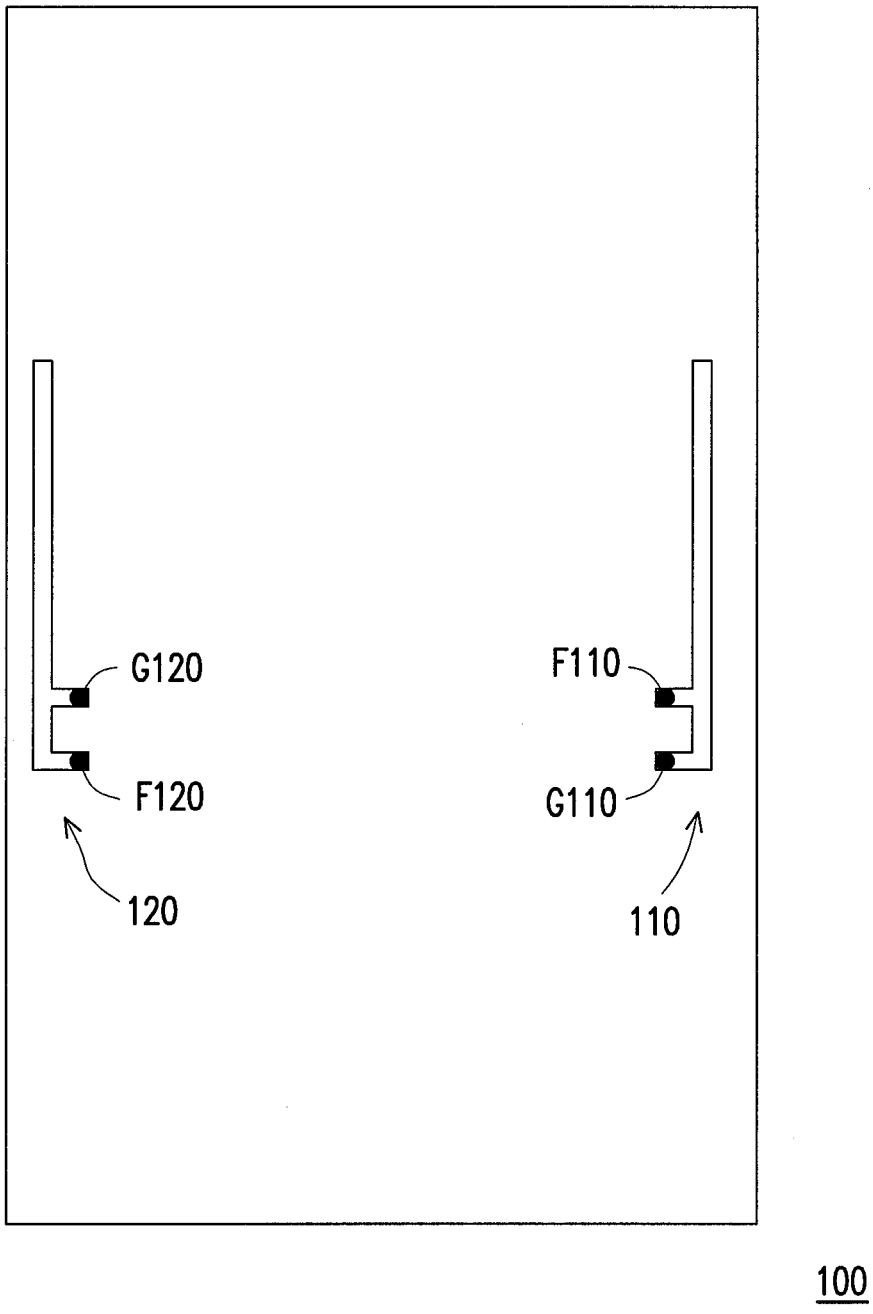
FIG. 1 (PRIOR ART)
FIG. 1 is a diagram of a conventional multi-input multi-output (MIMO) handheld device.

In a conventional multi-input multi-output (MIMO) handheld device, signal interference between planar antennas is serious and the planar antennas are difficult to be disposed.

In an embodiment of the subject application, two planar antennas are integrated into one planar antenna so that the total clearance area of the planar antenna is reduced and interference between two planar antennas is avoided. Reference will now be made in detail to exemplary embodiments of the subject application, examples of which are illustrated in the accompanying drawings. Wherever possible, the same reference numbers are used in the drawings and the description to refer to the same or like parts.

Figure 3:
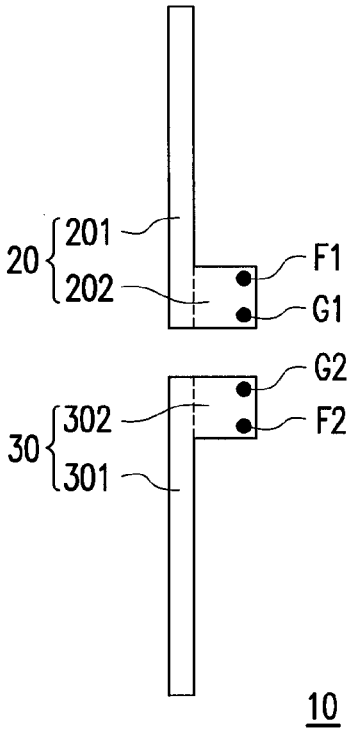
FIG. 3 is a diagram of two planar antennas according to a first embodiment of the subject application.

FIG. 3 is a diagram of two planar antennas according to a first embodiment of the subject application. The antenna portion 20 comprises a radiating portion 201 and an extending portion 202. The extending portion 202 is extended outwards from the radiating portion 201. The extending portion 202 comprises a feed point F1 and a ground point G1. The antenna portion 30 includes a radiating portion 301 and an extending portion 302. The extending portion 302 is extended outwards from the radiating portion 301. The extending portion 302 comprises a feed point F2 and a ground point G2. When the antenna portions 20 and 30 are disposed in a handheld device (not shown) with wireless communication functions, the feed points F1 and F2 are respectively connected to a feed end of the system ground plane (not shown). The ground points G1 and G2 are respectively connected to a ground end of the system ground plane. Thus, the handheld device can adopt a MIMO technique. The handheld device may be a smart phone, a personal digital assistant (PDA), a satellite navigation device, a smart e-book, a tablet or a notebook computer, etc.

In FIG. 3, the closer the antenna portion 20 and the antenna portion 30 are disposed, the more serious the signal interference problem is. Accordingly, in the present embodiment, the antenna portion 20 and the antenna portion 30 are integrated together by using a connecting portion so that the layout of the antennas is improved and signal interference between antennas is effectively avoided.

Figure 4:
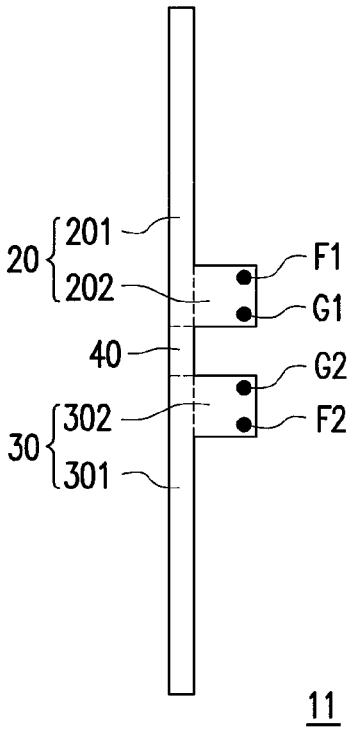
FIG. 4 is a diagram of a planar antenna according to the first embodiment of the subject application.

FIG. 4 is a diagram of a planar antenna according to the first embodiment of the subject application. Referring to FIG. 3 and FIG. 4, the planar antenna 11 is similar to two planar antennas 10. However, the planar antenna 11 further includes a connecting portion 40. The connecting portion 40 is connected between the antenna portion 20 and the antenna portion 30, and accordingly the ground points G1 and G2 are located between the feed points F1 and F2.

The planar antenna 11 is integrated with a MIMO function, and which comprises two feed points and two ground points. The feed point F1 and the ground point G1 are considered as the signal input/output terminals of the antenna portion 20, and the feed point F2 and the ground point G2 are considered as the signal input/output terminals of the antenna portion 30. In other words, the handheld device can carry out wireless communication through the antenna portion 20 and/or the antenna portion 30.

It should be noted that the connecting portion 40 is a conductive body connected between the antenna portions 20 and 30, and which changes the impedance between the antenna portions 20 and 30. In other words, those skilled in the art can adopt a connecting portion 40 of different impedance according to their actual requirement so that an impedance matching effect can be achieved. As a result, signal interference between antennas is reduced. Besides, by integrating the antenna portions 20 and 30, the total clearance area required by the antenna portions 20 and 30 is also reduced compared to that required by respectively disposed antennas.

Even though a possible pattern of the handheld device and the planar antenna thereof has been described in foregoing embodiment, it should be understood by those having ordinary knowledge in the art that different manufacturers have different designs of the handheld device and the planar antenna thereof. Thus, the application of the subject application is not limited to aforementioned possible pattern. In other words, it is within the scope and sprit of the subject application as long as the planar antenna comprises at least two feed points and at least two ground points and the ground points are located between the feed points. A few more embodiments of the subject application will be further described below so that those having ordinary knowledge in the art can further understand the spirit of the subject application and implement the subject application.

It should be understood by those skilled in the art that the pattern of the planar antenna and the dispositions of the feed points and the ground points illustrated in FIG. 4 are only selective embodiments and can be changed according to the actual requirement.

For example, the operating frequency of the antenna portion 20 may be changed by changing the length of the radiating portion 201. Similarly, the operating frequency of the antenna portion 30 may be changed by changing the length of the radiating portion 301.

Additionally, the center frequency of the antenna portion 20 may be changed by changing the distance between the feed point F1 and the ground point G1. Similarly, the center frequency of the antenna portion 30 may be changed by changing the distance between the feed point F2 and the ground point G2.

Figure 5:
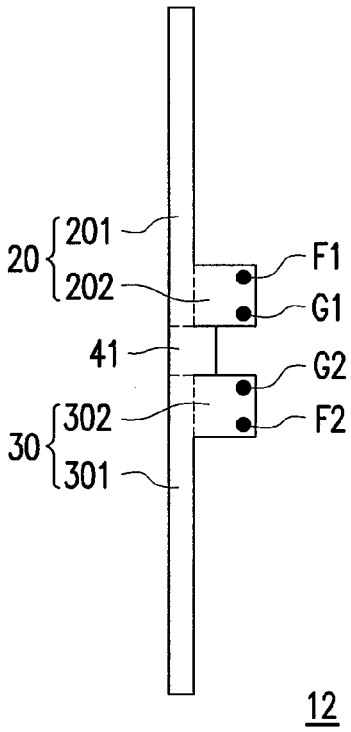
FIG. 5 is a diagram of a planar antenna according to a second embodiment of the subject application.

The pattern of the connecting portion 40 illustrated in FIG. 4 is only a selective embodiment too, and those skilled in the art may change the pattern of the connecting portion 40 according to their actual requirement so as to change the impedance of the connecting portion 40. FIG. 5 is a diagram of a planar antenna according to a second embodiment of the subject application. The planar antenna 12 in FIG. 5 is similar to the planar antenna 11 in FIG. 4. However, the connecting portion 41 in FIG. 5 is wider than the connecting portion 40 in FIG. 4. Accordingly, the impedance between the antenna portions 20 and 30 in FIG. 5 is reduced. Namely, the impedance of the connecting portion is in a positive correlation to the width thereof.

Figure 6:
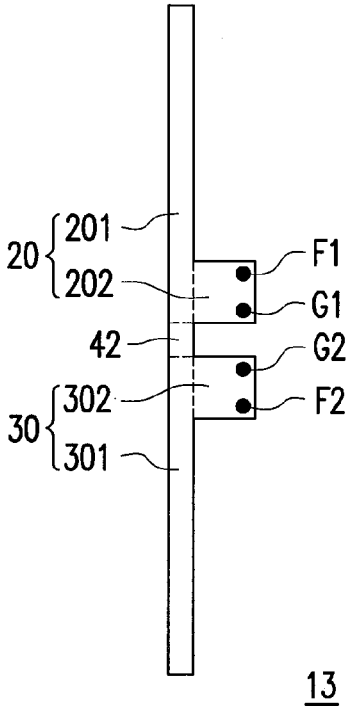
FIG. 6 is a diagram of a planar antenna according to a third embodiment of the subject application.

FIG. 6 is a diagram of a planar antenna according to a third embodiment of the subject application. The planar antenna 13 in FIG. 6 is similar to the planar antenna 11 in FIG. 4. However, the connecting portion 42 in FIG. 6 is shorter than the connecting portion 40 in FIG. 4. Accordingly, the impedance between the antenna portions 20 and 30 in FIG. 6 is reduced. Namely, the impedance of the connecting portion is in a negative correlation to the length thereof.

Figure 7:
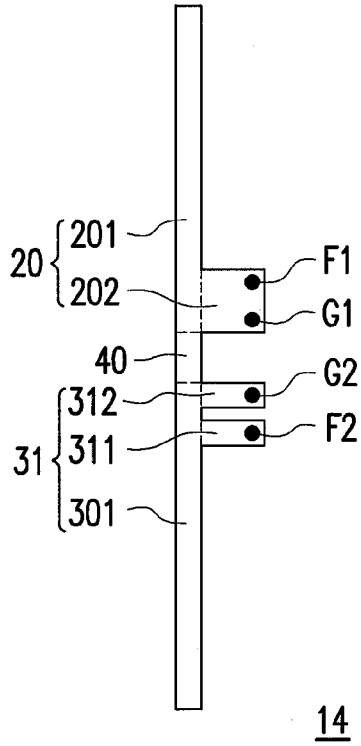
FIG. 7 is a diagram of a planar antenna according to a fourth embodiment of the subject application.

Even though the feed point F2 and the ground point G2 are disposed at the same extending portion 302 in FIG. 4, it is only a selective embodiment and the subject application is not limited thereto. In other embodiments, the feed point F2 and the ground point G2 may also be disposed at different extending portions. FIG. 7 is a diagram of a planar antenna according to a fourth embodiment of the subject application. The planar antenna 14 in FIG. 7 is similar to the planar antenna 11 in FIG. 4. However, the antenna portion 31 in FIG. 7 includes a radiating portion 301 and extending portions 311 and 312. In the present embodiment, the feed point F2 and the ground point G2 are respectively disposed at the extending portions 311 and 312 so that signal transmission paths between the feed point F2 and the ground point G2 are increased, and the center frequency of the antenna portion 31 is also changed.

Figure 8:
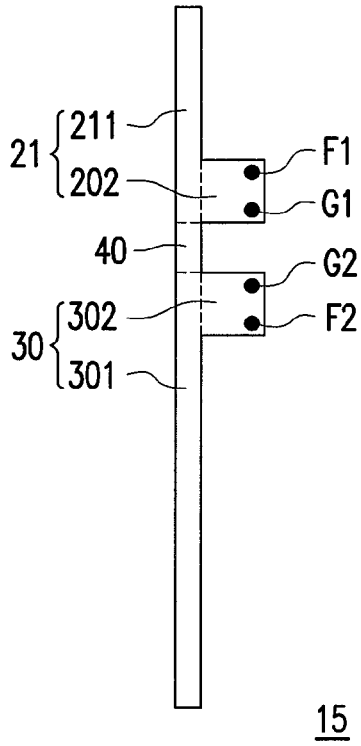
FIG. 8 is a diagram of a planar antenna according to a fifth embodiment of the subject application.

The length of the radiating portion may also be changed according to the actual requirement by those skilled in the art. FIG. 8 is a diagram of a planar antenna according to a fifth embodiment of the subject application. The planar antenna 15 in FIG. 8 is similar to the planar antenna 11 in FIG. 4. Referring to FIG. 8, the antenna portion 21 includes a radiating portion 211 and an extending portion 202. The antenna portion 30 includes a radiating portion 301 and an extending portion 302. It should be noted that the length of the radiating portion will affect the operating frequency of the antenna portion. Accordingly, in the present embodiment, the length of the radiating portion 211 is designed to be different from that of the radiating portion 301, so that the frequency of the antenna portion 21 and the frequency of the antenna portion 30 are with fundamental-harmonic relationships. For example, the frequency of the antenna portion 21 is approximately the second harmonic mode of the fundamental mode of the antenna portion 30. Thereby, the signal interference between the two antenna portions 21 and 30 is not very serious when the antenna portion 21 operates at the second harmonic mode and the antenna portion 30 operates at the fundamental mode.

Figure 9:
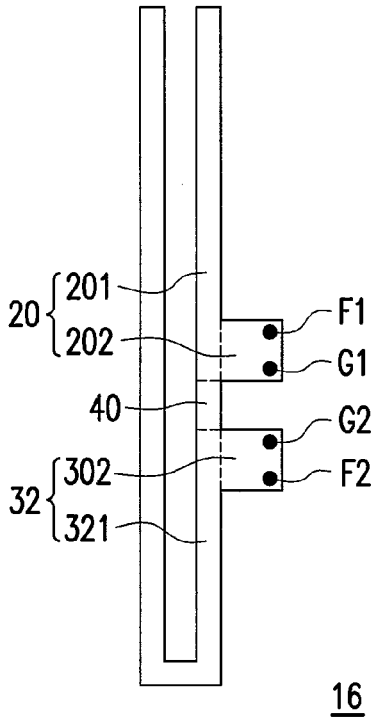
FIG. 9 is a diagram of a planar antenna according to a sixth embodiment of the subject application.

The pattern of the radiating portion may also be changed according to the actual requirement by those skilled in the art so as to improve the radiation pattern and the transceiving quality of the antenna or reduce signal interference of the antenna. FIG. 9 is a diagram of a planar antenna according to a sixth embodiment of the subject application. The planar antenna 16 in FIG. 9 is similar to the planar antenna 11 in FIG. 4. Referring to FIG. 9, the antenna portion 20 includes a radiating portion 201 and an extending portion 202. The antenna portion 32 includes a radiating portion 321 and an extending portion 302. The first end of the radiating portion 201 is connected to the connecting portion 40. The first end of the radiating portion 321 is connected to the connecting portion 40. It should be understood by those skilled in the art that the second end of the radiating portion 201 affects the radiation pattern of the antenna portion 20. Similarly, the second end of the radiating portion 321 also affects the radiation pattern of the antenna portion 32. In the present embodiment, the second end of the radiating portion 321 is pointed to the same direction as the second end of the radiating portion 201 by changing the pattern of the radiating portion 321, so that the radiation pattern and the transceiving quality of the antenna is improved and the signal interference of the antenna is reduced.

Figure 10:
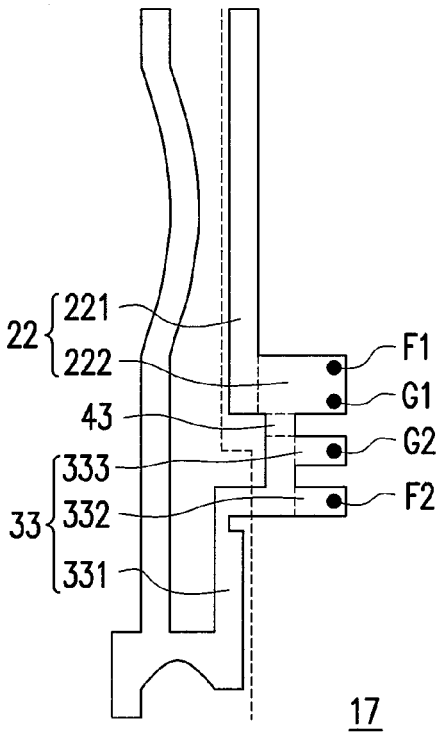
FIG. 10 is a diagram of a planar antenna according to a seventh embodiment of the subject application.

FIG. 10 is a diagram of a planar antenna according to a seventh embodiment of the subject application. Referring to FIG. 10, the antenna portion 33 of the planar antenna 17 includes a radiating portion 331 and extending portions 332 and 333. It should be noted that in the present embodiment, the radiating portion 331 can be designed to be in an irregular shape because of different reasons (for example, to fit in the space of the handheld device or to improve signal quality, etc). This also applies to the radiating portion 221 because of similar reasons.

Figure 11:
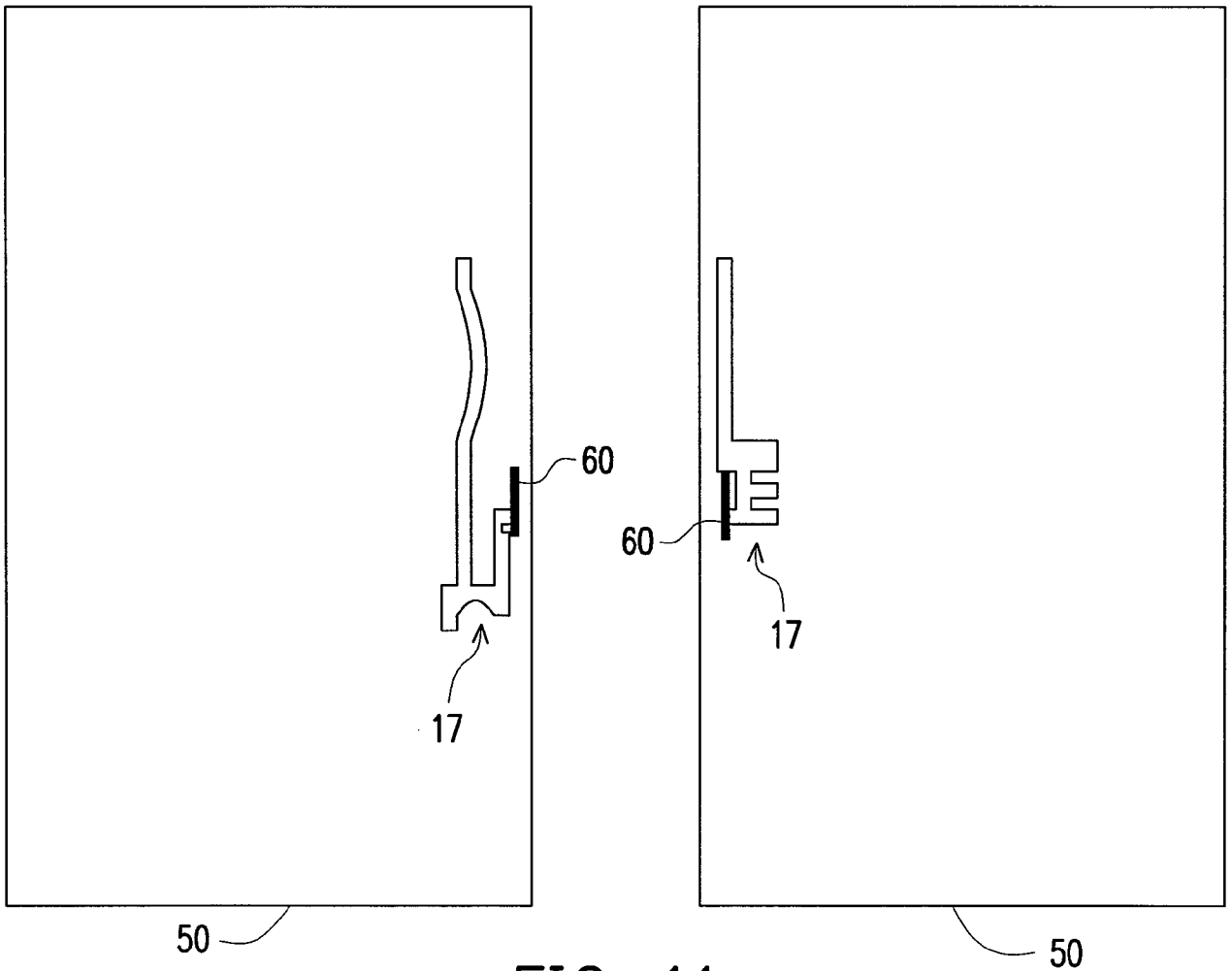
FIG. 11 is a diagram illustrating the disposition on both sides of a planar antenna according to the seventh embodiment of the subject application.

Because the planar antenna 17 is made of a flexible conductive material, it is flexible. The planar antenna 17 is flexibly disposed at a fixing device (for example, an antenna carrier, the casing of the handheld device, or any component or module in the handheld device) to form a three-dimensional (3D) structure. FIG. 11 is a diagram illustrating the disposition on both sides of a planar antenna according to the seventh embodiment of the subject application. Referring to FIG. 10 and FIG. 11, in the present embodiment, the fixing device is described as a base frame 50, wherein the base frame 50 has a through hole 60. The planar antenna 17 passes through the through hole 60 so that the antenna portion 22 and a portion of the antenna portion 33 are disposed on the first side of the base frame 50, and another portion of the antenna portion 33 is disposed on the other side of the base frame 50. Accordingly, the planar antenna 17 forms a 3D structure. However, in other embodiments, different fixing devices may be adopted by those skilled in the art to allow the planar antenna 17 to form different 3D structures.

Figure 2:
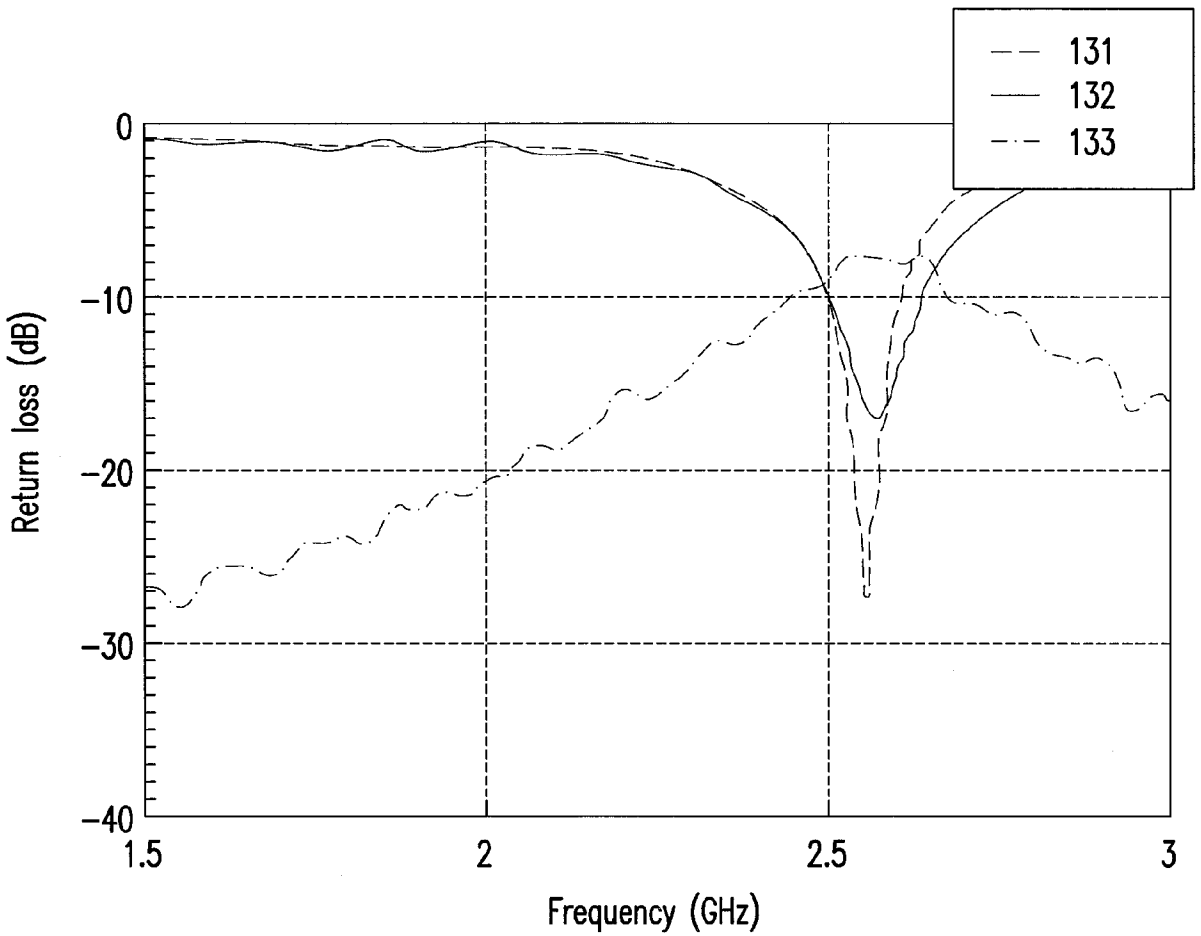
FIG. 2 (PRIOR ART)
FIG. 2 is a diagram illustrating the signal quality of a planar antenna in FIG. 1.
Figure 12:
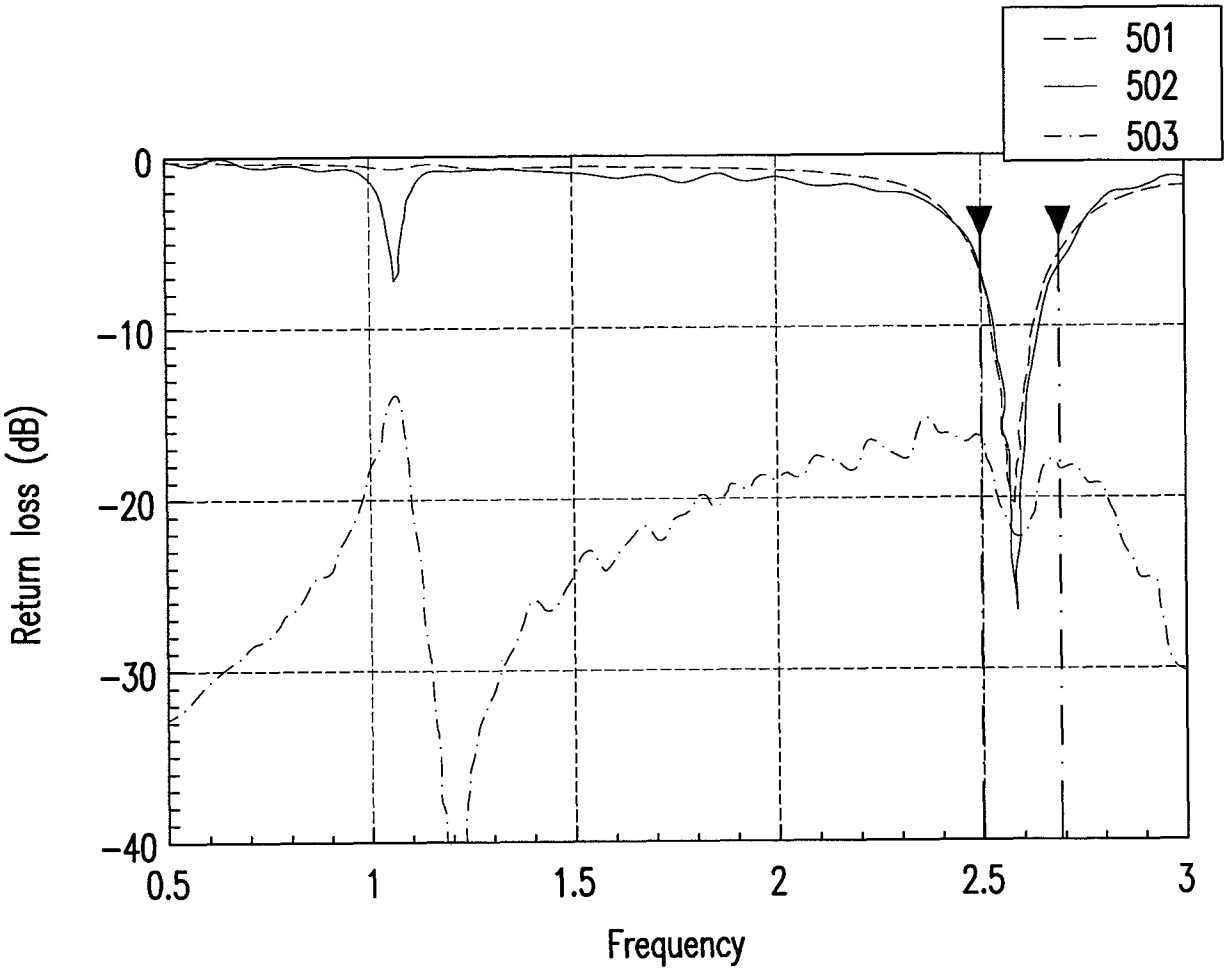
FIG. 12 is a diagram illustrating the signal quality (VSWR) of the planar antenna in FIG. 10.

FIG. 12 is a diagram illustrating the signal quality (VSWR) of the planar antenna in FIG. 10. Referring to FIG. 2 and FIG. 12, in FIG. 12, the curve 501 indicates the transceiving quality of the antenna portion 22, the curve 502 indicates the transceiving quality of the antenna portion 33, and the curve 503 indicates the situation of signal interference, wherein the antenna portion 33 may have more than two harmonic frequencies (for example, 1G-1.2G and 2.5G-2.7G), and the center frequency of the second harmonic oscillation may be operated within the same operating bandwidth as that of the antenna portion 22 through appropriate adjustment. As observed in FIG. 12, signal interference within the bandwidth of 2.5G-2.7G is effectively reduced. The transceiving quality illustrated in FIG. 12 is obviously improved compared with that illustrated in FIG. 4.

The planar antenna described in the present disclosure can be applied by those skilled in the art to wireless communication systems adopting MIMO techniques, such as WIMAX, GPS, and 3G, etc. In addition, the frequency of each antenna portion in the planar antenna can be fine tuned by those skilled in the art by using a matching circuit.

As described above, in the subject application, two antennas are integrated into one planar antenna comprising at least two feed points and at least two ground points, wherein the ground points are located between the feed points. Thereby, the layout of the planar antenna is made more flexible, and signal interference to the planar antenna is reduced. In addition, an embodiment of the subject application may further have following advantages:

1. The impedance of the connecting portion can be changed by changing the shape of the connecting portion, so that an impedance matching effect is achieved.

2. The center frequency of the antenna can be changed by changing the signal transmission path between the ground points and the feed points.

3. The operating frequency of the antenna can be changed by changing the length of the radiating portion of the antenna.

4. The two antennas in a planar antenna have radiating portions of different lengths. The two antennas operate at different harmonic frequencies but operating at the same bandwidth. Accordingly, signal interference is reduced.

5. The planar antenna is flexibly disposed at a fixing device to form a 3D structure.

It will be apparent to those skilled in the art that various modifications and variations can be made to the structure of the subject application without departing from the scope or spirit of the invention. In view of the foregoing, it is intended that the subject application cover modifications and variations of this invention provided they fall within the scope of the following claims and their equivalents.

What is claimed is:

1. A planar antenna, comprising:

a connecting portion;

a first antenna portion, comprising a first feed point and a first ground point, wherein a first end of the first antenna portion is connected to a first end of the connecting portion, the first feed point is located between the first end and a second end of the first antenna portion, and the first ground point is located between the first feed point and the first end of the first antenna portion; and a second antenna portion, comprising a second feed point and a second ground point, wherein a first end of the second antenna portion is connected to a second end of the connecting portion, the second feed point is located between the first end and a second end of the second antenna portion, and the second ground point is located between the second feed point and the first end of the first antenna portion, wherein the first antenna portion comprises a first radiating portion, the second antenna portion comprises a second radiating portion, a frequency of the first antenna portion is determined according to a length of the first radiating portion, a frequency of the second antenna portion is determined according to a length of the second radiating portion, and the frequency of the first antenna portion and the frequency of the second antenna portion are substantially with fundamental-harmonic relationships, such that a fundamental frequency of the first antenna portion has a multiple relation with a fundamental frequency of the second antenna portion, wherein the connecting portion, the first antenna portion, and the second antenna portion are made of a flexible conductive material, and the planar antenna is flexibly disposed at a fixing device to form a three-dimensional (3D) structure, wherein the first antenna portion and the second antenna portion are disposed on different sides of the fixing device.

2. The planar antenna according to claim 1, wherein the connecting portion has a width, and an impedance of the connecting portion is inversely proportional to the extent of the width, wherein a correlative direction of the width is perpendicular to a length of the connecting portion and the length is a distance between the first end of the connecting portion and the second end of the connecting portion.

3. The planar antenna according to claim 1, wherein the connecting portion has a length, and an impedance of the connecting portion is proportional to the extent of the length, wherein a correlative direction of the length is parallel to the length of the connecting portion and the length is a distance between the first end of the connecting portion and the second end of the connecting portion.

4. The planar antenna according to claim 1, wherein the first antenna portion comprises the first radiating portion and a extending portion, the extending portion is extended outwards from the first radiating portion, the first feed point and the first ground point are disposed at the extending portion, and a center frequency of the first antenna portion is determined according to a distance between the first feed point and the first ground point.

5. The planar antenna according to claim 1, wherein the second antenna portion comprises the second radiating portion, a first extending portion, and a second extending portion, the first extending portion and the second extending portion are respectively extended outwards from the second radiating portion, the second feed point and the second ground point are respectively disposed at the first extending portion and the second extending portion, and a center frequency of the second antenna portion is determined according to a signal path length between the second feed point and the second ground point.

6. A handheld device, comprising:

a planar antenna, comprising:

a connecting portion;

a first antenna portion, comprising a first feed point and a first ground point, wherein a first end of the first antenna portion is connected to a first end of the connecting portion, the first feed point is located between the first end and a second end of the first antenna portion, and the first ground point is located between the first feed point and the first end of the first antenna portion; and a second antenna portion, comprising a second feed point and a second ground point, wherein a first end of the second antenna portion is connected to a second end of the connecting portion, the second feed point is located between the first end and a second end of the second antenna portion, and the second ground point is located between the second feed point and the first end of the first antenna portion; and a system ground plane, electrically connected to the first feed point, the first ground point, the second feed point, and the second ground point, wherein the first antenna portion comprises a first radiating portion, the second antenna portion comprises a second radiating portion, a frequency of the first antenna portion is determined according to a length of the first radiating portion, a frequency of the second antenna portion is determined according to a length of the second radiating portion, and the frequency of the first antenna portion and the frequency of the second antenna portion are substantially with fundamental-harmonic relationships, such that a fundamental frequency of the first antenna portion has a multiple relation with the a fundamental frequency of the second antenna portion, wherein the connecting portion, the first antenna portion, and the second antenna portion are made of a flexible conductive material, and the planar antenna is flexibly disposed at a fixing device to form a three-dimensional (3D) structure, wherein the first antenna portion and the second antenna portion are disposed on different sides of the fixing device.

* * * * *